United States Patent [19]

Terry

[11] 4,113,313

[45] Sep. 12, 1978

[54] RECOVERING URANIUM FROM COAL IN SITU

[75] Inventor: Ruel Carlton Terry, Denver, Colo.

[73] Assignee: In Situ Technology, Inc., Denver, Colo.

[21] Appl. No.: 797,536

[22] Filed: May 16, 1977

[51] Int. Cl.[2] ..... E21B 43/28

[52] U.S. Cl. ..... 299/4; 166/256

[58] Field of Search ..... 299/2, 4, 5; 166/256–262; 175/12

[56] References Cited

U.S. PATENT DOCUMENTS

| | | | |
|---|---|---|---|
| 3,456,730 | 7/1969 | Lange | 166/256 |
| 3,502,372 | 3/1970 | Prats | 299/5 |
| 3,765,722 | 10/1973 | Crumb | 299/2 |

*Primary Examiner*—Ernest R. Purser

[57] ABSTRACT

An underground carbonaceous deposit containing other mineral values is burned in situ. The underground hot zone is cooled down to temperature below the boiling point of a leaching solution. The leaching solution is percolated through the residial ash, with the pregnant solution recovered for separation of the mineral values in surface facilities.

11 Claims, 2 Drawing Figures

RECOVERING URANIUM FROM COAL IN SITU

BACKGROUND OF INVENTION

There are many coal deposits around the world that contain a considerable amount of uranium and other valuable minerals. In the United States uranium entrained in coal was known as early as 1874 and was so reported by Berthoud, "On the occurrence of uranium etc. in the tertiary formation of Colorado Territory," Philadelphia Academy of Natural Sciences Proceedings, 1875. The intense interest in uranium spawned by World War II led to numerous discoveries of uranium in coal in North Dakota, South Dakota, New Mexico, Texas and Wyoming.

One such discovery is reported in detail in U.S. Geological Survey Bulletin 1099-B, "Uranium-Bearing Coal in the Eastern Part of the Red Desert Area, Wyoming 1962." In this deposit one seam of coal containing 2 million tons has an average uranium content of 0.01%. Localized concentrations of coal has up to 0.14% uranium values in the ash.

In several cases in the United States where the uranium-bearing coal was overlain by shallow overburden, the coal was strip mined and then burned to ash. The ash provided concentrations of uranium that facilitated commercial recovery. Since the fuel value of the coal was not utilized, such procedures were limited by economics to coal deposits near the surface.

Generally, uranium bearing coals tend to be of poor quality as fuels due to relatively high ash and moisture contents. For the most part the uranium values of interest appear to be emplaced as a secondary deposition from uranium-bearing waters percolating through the coal, and such deposits are normally associated with a porous rock formation overlying the coal. In a setting of this type uranium values reach their maximum in the upper portion of the coal seam. In some cases the upper portion of the coal seam is carbonaceous material that is very effective in removing uranium values from percolating water, but is very poor as a fuel. Such deposition of uranium values by adsorption by the coal is an irreversible process.

It is well known in the art how to produce coal in situ. Methods of such production are taught in U.S. Pat. Nos. 3,924,680, 3,948,320, 3,952,802, 3,987,852, 4,010,800, 4,010,801 and 4,018,481. One problem in producing coal in situ by burning is the tendency toward flame override, resulting in rapid consumption of the uppermost coal in the seam with corresponding difficulties in consuming the coal in the lower part of the seam. Flame override is an advantage when it is desirable to convert the uppermost portion of the coal to ash. Further, in situ burning processes can be accomplished at depths unfavorable for strip mining or for conventional underground mining. In many cases the removal of the uppermost portion of the coal has little effect on the value of the coal deposit as a fuel because of the low quality of the coal consumed.

It is well known in the art how to extract uranium values from porous host material by leaching with a liquid that will take the uranium values into solution. Common leaching liquids for this purpose include solutions of sodium carbonate and solutions of sulfuric acid. Uranium values taken into solution are readily extracted by one of several commercial processes.

No particular novelty is claimed in producing coal in situ. No particular novelty is claimed in extracting uranium values by leaching. It is an object of the instant invention to teach methods combining those used in producing coal in situ together with those used in leaching uranium values in order to recover uranium and other minerals from coal in situ. Those skilled in the art will be able to envision modifications to methods taught herein that can be used to remove other valuable constituents of the residual ash such as vanadium, chromium, germanium, nickel, and the like.

Other objects, capabilities and advantages of the instant invention will become apparent as the description proceeds and in conjunction with the drawings.

SUMMARY OF THE INVENTION

By way of example a coal seam is described at a depth of 300 feet below the surface. The seam is 30 feet thick and in the upper 10 feet uranium values average 0.02%, while the lower 20 feet contain uranium values averaging 0.001%. Ash content of the coal in the upper 10 feet averages 15%. Two or more wells are drilled from the surface of the ground to a point located approximately one-third of the way into the coal seam. The wells are hermetically sealed and the coal is ignited using standard in situ gasification techniques. Burning continues until substantially all of the coal between the wells in the upper 10 feet of the seam is reduced to ash. Water is injected into the burned out area until the temperature of the formation is reduced to approximately the boiling point temperature of water. A specially prepared liquid, having the capability of taking uranium values into solution, is percolated through the residual ash and the pregnant solution is returned to the surface.

DESCRIPTION OF THE PREFERRED EMBODIMENT

Figure 1:
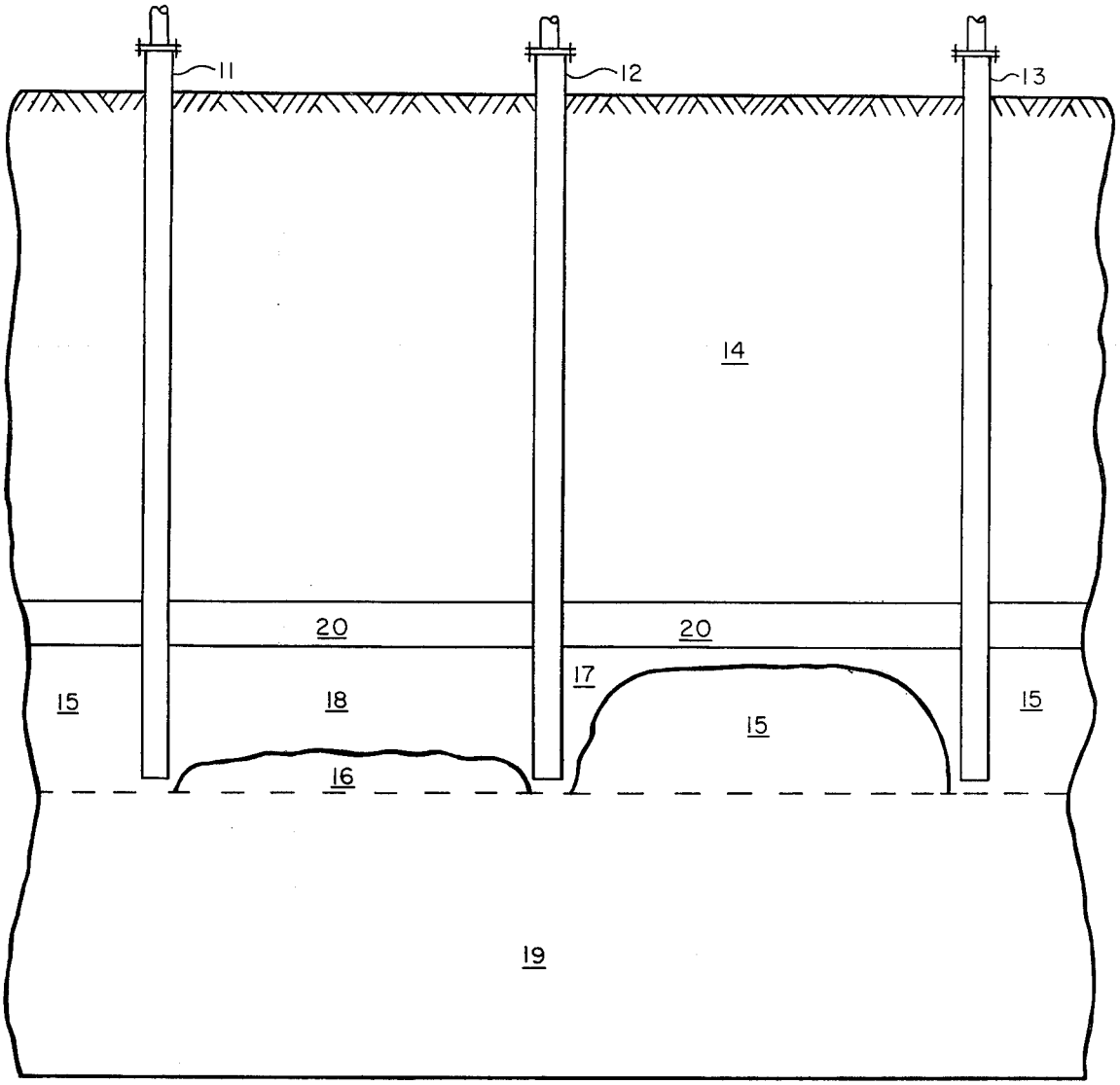
FIG. 1 is a diagrammatic vertical section taken through a portion of the earth showing a uranium bearing coal seam and the arrangement of apparatus for the methods of the invention.

Referring to the FIG. 1, a section of the earth is shown including the overburden 14 overlying a coal seam located, for example, 300 feet below the surface of the ground. The upper portion of the coal seam 15 contains uranium values of interest, for example 0.02% uranium, while the lower portion of the seam 19 has uranium values, for example 0.001% uranium, of no commercial interest. As an example of the methods of the invention, three wells 11, 12, 13 have been drilled from the surface of the ground into the coal seam, with the bottom of the wells located in the lowermost portion of upper section of the coal seam 15. The wells are hermetically sealed using techniques common in the production of coal in situ. As illustrated the coal has been consumed by fire between well 11 and well 12, leaving void space 18 and residual ash 16. Between wells 12 and 13 the burning of coal 15 is in the early stages with void space 17 representing the portion of the coal consumed. A porous sandstone 20 overlies the coal seam.

Starting with the virgin coal, the process begins by drilling and completing wells 11 and 12. Compressed air, for example 150 psig, is injected into well 12 with well 11 remaining open. After a period of time, the compressed air, which is migrating in numerous directions through the coal away from well 12, will eventually break through to well 11. Upon breakthrough hot ignition material, for example incandescent charcoal briquettes, is dropped into well 11 and ignition of the coal will occur within minutes. By continuing injection of compressed air, the fire will burn toward the on coming oxygen and in time will burn a channel through the coal thereby connecting wells 11 and 12. At burn-through the injected air will show a significant pressure drop, for example to 50 psig. The burn continues with air injected into well 12 at a lower pressure, for example 50 psig, until a substantial amount of the coal between wells 12 and 11 is consumed and reduced to ash 16.

The uranium values in the coal remain well below their vaporization temperature throughout the burn. Therefore the uranium values dispersed throughout the coal are now concentrated in the residual ash 16. Whereas the coal as described contained 0.02% uranium, the residual ash now contains approximately 0.13% uranium, a concentration of commerical interest.

For the methods of the instant invention it is important that the underground temperatures be controlled to a level below that of the fusion temperature of the ash. It is preferable that the residual ash 16 be maintained as dry ash, so that later in the process a leaching liquid may be circulated through the ash to take the uranium values into solution for uranium recovery in surface facilities. To control the maximum temperatures of the underground reaction, it is preferable to inject water along with the oxidizer at proper rate, for example water in the form of vapor in the range of 0.1 to 0.5 pounds of water for each pound of coal consumed in the fire. Water requirements is a function of the fusion point temperature of the ash. If the fusion point temperature of the ash is in the order of 2,300° F., for example, water may be satisfactorily injected at the rate of approximately 0.25 pounds of water for each pound of coal consumed. The water injected preferably would be local water, which may have contained within itself in the order of 50 parts per billion of uranium values. Thus the water consumed in the underground reactions would further deposit uranium values in the ash.

The course grained sandstone 20 overlying the coal seam also may contain significant amounts of uranium values. When significant void spaces 18 are burned out underground, roof falls of the overlying sandstone 20 can be expected, thereby positioning the sandstone 20 atop of the residual ash 16, and thus presenting the opportunity to circulate leaching liquids through the sandstone as well as the residual ash. Should subsidence of the overburden become a problem, appropriate remedial action can be taken as taught in my co-pending patent application Ser. No. 774,597 filed Mar. 7, 1977.

In some cases the mineralized portion of the carbonaceous material 15 may be such a poor fuel as to cause difficulties in sustaining the underground fire. In these cases it may be necessary to supply outside fuel values to maintain the underground reactions. Such outside fuel preferably is mixed with the injected oxidizer. Such fuel gas may be obtained by gasifying coal 19 using methods taught in U.S. Pat. No. 4,018,481 or similar in situ gasification techniques. Any convenient source of outside fuel however can be employed including butane, propane and natural gas.

Figure 2:
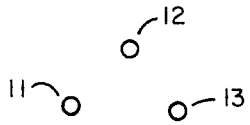
FIG. 2 is a plan view of a possible well pattern.

In commercial practice a multiplicity of wells 11, 12 and 13 would be drilled to a predetermined well pattern such as illustrated in FIG. 2. The wells would be linked together through the coal seam as described in the foregoing. Each well preferably would be equipped to serve alternately as an injector well and a fluid withdrawal well. Alternating the role of each well will serve to facilitate the reasonable uniform consumption of the coal. The wells could be spaced apart a convenient distance, for example in the range of 50 feet to 300 feet. When an appropriate amount of coal 15 is consumed and reduced to ash, for example an area extent of 10 acres, burning is terminated and a cool down of the affected area is initiated.

Cool down is accomplished by copious injection of water or other fluid into the hot area. Use of local water containing uranium values is preferred because the water will be consumed in underground reactions in the early stages of cool down and will be converted to steam in the later stages. In both cases the uranium values in the water will be left as residual uranium to enhance the uranium values to be leached.

In the early stages of cool down the water will react with hot residual coal to form blue gas (hydrogen plus carbon monoxide) which may be used as supplemental fuel to a nearby mining area as described in the foregoing. In the later stages of cool down when the water no longer enters the underground chemical reaction, the steam generated may be used to inject into a nearby mining area to control the temperature of underground reactions, also described in the foregoing.

When the temperature of the underground hot area is reduced to the point where the injected water no longer flashes to steam, water injection is terminated and injection of leaching liquids begins. Virtually all coal seams have some dip as measured against the horizontal. The leaching liquids are injected preferably on the updip side of the zone to be leached, allowing the leaching liquids to percolate by gravity through the uranium bearing residual ash and, if present, coarse sandstone that has fallen onto the residual ash. The pregnant leaching liquid with its uranium content is captured downdip and pumped to surface facilities. The leaching fluid, for example a solution of water and sodium carbonate, could be any of those normally used for leaching uranium ore. Should other minerals of commercial interest be entrained in the residual ash, a leaching solution capable of extracting the mineral values would be used to complete the processes described in the foregoing.

Thus it may be seen that a carbonaceous deposit containing mineral values of commercial interest may be reduced to ash thereby concentrating the mineral values where such minerals may be taken into solution and recovered in surface facilities. While the present invention has been described with a certain degree of particularity, it is understood that the present disclosure has been made by way of example and that changes in detail of structure may be made without departing from the spirit thereof.

What is claimed is:

1. A method of recovering mineral values adsorbed in an underground coal deposit, comprising the steps of establishing a first passage between a surface location and the underground deposit of coal, establishing a second passage between a surface location and the underground deposit of coal, the said second passage being spaced apart from the said first passage, establishing a third passage between the said first passage and the said second passage, the said third passage being located in the said coal.

igniting the said coal, injecting an oxidizer into the said coal, burning a portion of the said coal to residual ash, terminating injection of said oxidizer, injecting a cooling fluid into the burned out area, continuing injection of the said cooling fluid until the temperature of the said residual ash is below the boiling point temperature of a leaching liquid, terminating injection of the said cooling fluid, injecting the said leaching fluid through the said first passage, percolating the said leaching fluid through the said residual ash, and capturing the said leaching fluid together with the mineral content taken into solution in the said leaching fluid and delivering the pregnant solution to the surface of the ground.

2. The method of claim 1 further including the step of capturing the products of combustion at the surface of the ground.

3. The method of claim 1 further including the step of capturing the products generated by the said injection of the said cooling fluid.

4. The method of claim 1 wherein the spacing of the said first passage and the said second passage is in the range of 50 to 300 feet.

5. The method of claim 1 further including the step of injecting a fuel together with the said oxidizer.

6. The method of claim 5 wherein the said fuel is apportioned to sustain burning of the said coal.

7. The method of claim 6 wherein the water is apportioned in the range of 0.1 to 0.5 pounds of water for each pound of coal consumed in the processes.

8. The method of claim 1 further including the step of injecting water together with the said oxidizer.

9. The method of claim 8 wherein the said water is apportioned to maintain the underground reaction temperature below the fusion point temperature of the said residual ash.

10. The method of claim 1 wherein the said cooling fluid is water.

11. The method of claim 10 wherein the water contains trace quantities of the mineral to be recovered.

* * * * *